US010566113B2

(12) United States Patent
Koeppendoerfer et al.

(10) Patent No.: US 10,566,113 B2
(45) Date of Patent: Feb. 18, 2020

(54) METHOD FOR PRODUCING AN ELECTRICAL LINE, ELECTRICAL LINE, AND VEHICLE ON-BOARD POWER SUPPLY SYSTEM HAVING A CORRESPONDING ELECTRICAL LINE

(71) Applicant: LEONI KABEL GMBH, Nuremberg (DE)

(72) Inventors: Erwin Koeppendoerfer, Schwabach (DE); Markus Schill, Munich (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/412,117

(22) Filed: Jan. 23, 2017

(65) Prior Publication Data

US 2017/0133128 A1 May 11, 2017

Related U.S. Application Data

(63) Continuation of application No. PCT/EP2015/066800, filed on Jul. 22, 2015.

(30) Foreign Application Priority Data

Jul. 23, 2014 (DE) ..... 10 2014 214 461

(51) Int. Cl.

| | |
|---|---|
| ***H01B 13/14*** | (2006.01) |
| ***H01B 13/00*** | (2006.01) |
| ***B21C 23/22*** | (2006.01) |
| ***H01B 7/02*** | (2006.01) |

(52) U.S. Cl.
CPC ..... *H01B 13/0006* (2013.01); *B21C 23/22* (2013.01); *H01B 7/02* (2013.01); *H01B 13/14* (2013.01)

(58) Field of Classification Search
CPC ..... B21C 23/24; B21C 23/26; B21C 23/30; B21C 25/08; B21C 23/22; H01B 13/0006; H01B 7/0275; H01B 7/201; H01B 13/14; H01B 13/145; H01B 13/143; H01B 13/144; H01B 13/0013
See application file for complete search history.

(56) References Cited

U.S. PATENT DOCUMENTS 1,943,087 A 1/1934 Potter et al.
1,956,834 A * 5/1934 Price ..... B21C 23/30 29/728

(Continued)

FOREIGN PATENT DOCUMENTS

DE 68915881 T2 10/1994
DE 102010046955 A1 10/2011

(Continued)

*Primary Examiner* — Edward T Tolan
(74) *Attorney, Agent, or Firm* — Laurence A. Greenberg; Werner H. Stemer; Ralph E. Locher

(57) ABSTRACT

A cable has a wire bundle composed of a number of individual wires and an insulating sheath. The wire bundle is guided along a longitudinal center axis by a shaping element in order to guide and to specify the cross-sectional shape of the wire bundle in a feeding region immediately upstream of an extruder. The shaping element rotates about the longitudinal center axis, and the insulating sheath is subsequently applied to the wire bundle by the extruder.

9 Claims, 2 Drawing Sheets

(56) References Cited

U.S. PATENT DOCUMENTS 2,262,716 A * 11/1941 Wolfer ..... B21C 23/30 164/461
2,760,229 A * 8/1956 Cheney ..... B29C 47/0004 118/405
2,863,171 A * 12/1958 Von Bergen ..... B29C 47/28 425/114
2,885,777 A * 5/1959 Gliss ..... B29C 47/0038 118/405
3,204,326 A * 9/1965 Granitsas ..... B21C 23/26 228/188
3,227,801 A * 1/1966 Demmel ..... H01B 11/04 174/34
3,234,722 A 2/1966 Gilmore
3,406,248 A * 10/1968 Bunish ..... B29C 47/0016 174/120 R
3,582,417 A * 6/1971 Plate et al. ..... B29C 47/027 156/51
3,842,632 A * 10/1974 Nelson ..... B21J 7/16 433/165
4,125,741 A * 11/1978 Wahl ..... H01B 7/0009 174/113 A
4,210,012 A * 7/1980 Dameron, Jr. ..... D07B 7/02 72/235
4,426,837 A 1/1984 Meilenner et al.
4,471,161 A 9/1984 Drummond
4,600,268 A * 7/1986 Spicer ..... G02B 6/4416 174/113 C
4,659,424 A * 4/1987 Baxter ..... G01B 7/30 156/51
5,003,761 A 4/1991 Iura et al.
5,449,861 A 9/1995 Fujino et al.
5,831,210 A 11/1998 Nugent
6,362,431 B1 3/2002 Gutierrez et al.
9,492,856 B2 * 11/2016 Hanazaki ..... B21C 1/00
2009/0089998 A1 * 4/2009 Varkey ..... H01B 13/24 29/825
2010/0078195 A1 * 4/2010 Patel ..... H01B 9/027 174/113 R
2013/0161855 A1 * 6/2013 Crouse ..... H01B 13/24 264/103
2015/0096781 A1 4/2015 Fichtner et al.

FOREIGN PATENT DOCUMENTS

EP 0802701 A2 10/1997
EP 1191545 A1 3/2002
JP S4854227 A 7/1973
JP S499686 A 1/1974
JP S5622008 A 3/1981
JP H02170314 A 7/1990
JP H05101728 A 4/1993
JP H05128923 A 5/1993
JP H0583933 U 11/1993
JP H07249329 A 9/1995
JP H07282656 A 10/1995
JP H09237533 A 9/1997
JP 2011044370 A 3/2011
JP 2014060061 A 4/2014
WO 2013131779 A1 9/2013

* cited by examiner

METHOD FOR PRODUCING AN ELECTRICAL LINE, ELECTRICAL LINE, AND VEHICLE ON-BOARD POWER SUPPLY SYSTEM HAVING A CORRESPONDING ELECTRICAL LINE

CROSS-REFERENCE TO RELATED APPLICATION

This is a continuation application, under 35 U.S.C. § 120, of copending international application No. PCT/EP2015/066800, filed Jul. 22, 2015, which designated the United States; this application also claims the priority, under 35 U.S.C. § 119, of German patent application No. DE 10 2014 214 461.2, filed Jul. 23, 2014; the prior applications are herewith incorporated by reference in their entirety.

BACKGROUND OF THE INVENTION

Field of the Invention

The present invention relates to a method for producing an electrical line having at least one conductor, which has a wire bundle made up of a number of single wires, and an insulating sheath surrounding the wire bundle. The present invention furthermore relates to such an electrical line and a motor vehicle on-board power supply system having a corresponding electrical line.

Such a method and such an electrical line may be found, for example, in U.S. Pat. No. 4,471,161. A stranded conductor and its production are described therein, in which a plurality of single wires is stranded into a stranded wire with the aid of a stranding machine. The stranded wire thus produced is also surrounded by an extruded sheath for forming the conductor. Such conductors having stranded wire are used in particular for applications in which high flexibility of the line is desired. Due to the many single wires in the stranded wire, such flexibility is provided in comparison, for example, to conductors having a line in the form of a solid wire.

Furthermore, for example, a stranding machine for producing stranded single wires having a reverse lay (SZ stranding) may be found in U.S. Pat. No. 4,426,837. Here, the single wires are rotated together with an elongate tube within which they are guided. By rotating the tube, the single wires are stranded together when exiting the tube and are there fed to an extruder for applying a sheath.

In the production of stranded wires, it is, for example, known in principle from German utility model DE 689 15 881 T2, from published, European patent application EP 1 191 545 A1, or also from U.S. Pat. No. 5,449,861 B, to compact the stranded wires, i.e., to compress the single wires against each other. During the concentric or bunch stranding process, the single wires or bundles of single wires are generally initially fed to a stranding element, for example, a stranding nipple or a stranding disk. If compacting is desirable, for example, the stranding nipple is correspondingly configured so that it performs compacting. German utility model DE 689 15 881 T2 describes the use of a drawing die. In all cases, the wire bundle which is brought together in such a way is fed to a stranding machine, at the end of which the stranded wire bundle is wound onto a take-up reel. The insulating sheath is generally subsequently applied around the stranded wire bundle in a separate method step.

However, such a concentric or bunch stranding process is very complex overall, thus, for example, resulting in higher costs in comparison to conductors having a solid wire instead of a stranded wire.

If the stranded wires are to be used in the automotive field, for example, as part of an on-board power supply system, the design of the stranded wire is also typically adapted to certain standards, as may be found, for example, in JIS C 3406-1987 or JASO D 611-94. The stranded wires in the automotive field are typically designed for low voltages. They should generally be as compact as possible, as well as light. With respect to a design which is as compact as possible, for example, is it known from JASO D 611-94 to compact the stranded wires in order also to press the stranded assembly in particular into a circular shape. For reducing weight, wires having reduced, thin-wall insulation, so-called FLRY cables, are known. Stranded wires for the automotive field for low voltages and low currents typically have a stranded element made up of a plurality of single wires, generally 7 to 70, in particular 7 to 37, each having a single-wire diameter in the range of 0.18 to 0.32 mm, so that the stranded wire has a diameter in the range of approximately 0.8 mm to 2 mm.

SUMMARY OF THE INVENTION

On this basis, the object of the present invention is to enable cost-effective production of a flexible line.

Here, the method is used for producing a cable having a wire bundle made of a number of single wires and having an insulating sheath. The sheath is produced by an extruder, wherein the wire bundle made up of long single wires is continuously fed to the extruder in a feeding area for this purpose. For specifying the cross-sectional shape of the wire bundle, the wire bundle is now guided through a shaping element along the center longitudinal axis in the feeding area immediately ahead of the extruder, wherein the shaping element rotates about its center longitudinal axis and around the wire bundle. Immediately following the shaping element, the insulating sheath is applied to the wire bundle by the extruder. Thus, a relative rotational movement of the shaping element around the wire bundle takes place. The desired cross-sectional shape of the wire bundle in the finished conductor is set by means of the shaping element. For this purpose, the in particular loose single wires of the wire bundle are brought together in a radial direction.

The wire bundle is thus virtually prepared immediately ahead of the extruder in the feeding area for the treatment in the extruder, whereby inter alia the application of the insulating sheath to the wire bundle is facilitated. In this case, this embodiment is based on the fundamental consideration of omitting the expensive stranding with the aid of a stranding machine, and feeding the wire bundle unstranded, or at least without directed stranding, to the extruder. The shaping element is thus used to bring the wire bundle into a desired, for example, circular, form. Rotation of the wire bundle jointly with the rotating shaping element or twisting of the single wires with each other with the aid of the rotating shaping element does not take place. In this shape which is impressed onto the wire bundle by the shaping element, the wire bundle is then immediately fed to the extruder, so that the insulation applied via the extrusion process holds the wire bundle in the specified desired geometry. "Immediately following" may therefore be understood to mean that the geometry specified by the shaping element is still maintained and is directly fixed in an extrusion step which immediately follows both temporally and spatially.

The rotating shaping element is of particular significance due to the fact that it rotates about its center longitudinal axis, i.e., it generally rotates around a feed direction of the single wires. As a result, forces which act on the single wires when guiding the single wires through shaping element are better distributed, since the shaping element rotates relative to the wire bundle. As a result, the strain on the single wire is reduced and the risk of a wire breaking while guiding the single wires through the shaping element is reduced.

As a result of this measure, no stranding is necessary overall. Here, stranding is generally understood to mean any directed twisting of the single wires relative to each other about a center longitudinal axis, after unwinding from a reel. This includes conventional concentric stranding, in which the single wires are stranded in layers around a central conductor and thus have a symmetrical, concentric structure. However, in the broader context, stranding may also presently be understood to mean so-called bunch stranding, in which the single wires in the bundle are twisted about a center longitudinal axis, wherein in this bunch stranding, no defined position of the single wires is achieved, as is the case in the conventional concentric stranding process.

The line thus produced is produced in a continuous process as a virtually endless product typically having a length of several hundred meters. After applying the sheath, the line is therefore typically also wound onto a reel.

In a preferred refinement, such directed concentric stranding or bunch stranding, in particular a stranding machine, is therefore also omitted altogether, and the single wires are present in the wire bundle untwisted or at least largely untwisted. The single wires therefore run in parallel with each other in good approximation. They are fed to the shaping element at least essentially, and preferably exactly, in parallel, and also continue to be guided in parallel within it, and leave the shaping element untwisted.

Alternatively to an exactly parallel orientation, in an expedient embodiment, a comparatively large lay length of greater than 0.5 m and in particular greater than 2 m, up to an infinite lay length of the single wires running in parallel, is provided. Here, the lay length denotes the length in which the wire bundle rotates once by 360° around its own center longitudinal axis. Such a feed which is not exactly parallel results in any case from unwinding the wire bundle from an in particular stationary reel. Here as well, an active (rotating) concentric or bunch stranding element, and thus the conventional stranding machine, is omitted.

Generally, the arrangement of the shaping unit may be used immediately ahead of the extruder, even with stranded wires. Here, it is of particular importance that the shaping element rotates around the wire bundle, whereby the strain on the single wires is kept low. In this case, a wire bundle which has already been stranded is fed to the shaping element. This bundle is in turn guided through the rotating shaping element without rotating with it. Here as well, a desired shaping takes place, so that the finished wire has excellent roundness, and the subsequently applied sheath has high concentricity with respect to the wire bundle. After the stranding process and, for example, after multiple redirections, the wire bundle is brought into the desired shape, in particular, rounded, via the shaping element.

From the production standpoint, in the non-stranded design variant, the single wires are generally unwound as a more or less loose bundle from a supply, in particular a reel, and fed to the shaping element. If necessary, multiple single wires or bundles of single wires may also be initially brought together from multiple supplies ahead of the shaping element, and combined in the shaping element into the wire bundle.

In this case, if the bundle is not unwound from a reel which is also rotating, but rather from a stationary reel, this typically results in twisting, more precisely, bunching, of the single wires in the wire bundle, which is not produced in a directed manner, due to the unreeling process, so that the single wires, as specified above, are not fed exactly in parallel. In this case, however, a comparatively great lay length of at least more than 0.5 m and in particular of at least more than 2 m results. In the case of twisting which is produced in a directed manner for certain application purposes in the automotive field, the lay length, however, is in the range of several millimeters up to 0.1 m.

As a result, by omitting the complex stranding process, an economical production process is achieved overall. Simultaneously, through the use of single wires, the desired high flexibility of the line is still maintained.

A particular advantage of the great to infinite lay length is also to be seen in the material savings and weight reduction due to the great or infinite lay length, which is of particular significance in particular for the intended application area in the automotive field. In comparison to conventional stranded wire, savings of approximately 1% may be achieved by this alone.

In this case, it is particularly important that the preparation of the wire bundle takes place immediately ahead of the extruder with the aid of the shaping element. Correspondingly, the shaping element in which the preparation of the wire bundle takes place is preferably positioned at a distance of less than 2 m and in particular less than 0.5 m from the extruder, i.e., from the extruder entrance.

According to an advantageous method variant, furthermore, the shaping element is used to place the single wires next to each other, transversely to the longitudinal direction of the single wires, wherein a wire bundle having an approximately cylinder jacket-shaped surface is typically formed as a result. In this way, a wire bundle is created which has a thickness which is as low as possible or a diameter which is as small as possible. According to a first embodiment variant, the single wires are not deformed in this case. The single wires which are thus placed next to one another are immediately thereafter enclosed in the extruder by the insulating sheath, typically a plastic, so that the shape of the wire bundle, which is specified via the shaping element, is retained by the sheath.

For this purpose, the shaping element is advantageously configured as a shaping sleeve, i.e., as an at least partially hollow cylinder-shaped and/or truncated cone-shaped body, via which the wire bundle in the feed area is guided immediately ahead of the extruder. The dimensions of the shaping sleeve are selected according to the first embodiment variant in such a way that the relative position of the single wires in the wire bundle with respect to the longitudinal axis of the wire bundle is not affected; rather, they are geometrically reshaped.

In a preferred second alternative, not only does a kind of orientation or repositioning of the single wires in the wire bundle take place via the shaping element, but also a compression of the wire bundle, in which the single wires in the wire bundle are pressed together when drawing through the shaping element, in order thus to further reduce the thickness of the wire bundle or the diameter of the wire bundle. In this case, the shaping element has a conical inlet area and tapers to a final diameter which is measured in such a way that the desired compression takes place. Here, compression may be understood to mean a reduction of the diameter of the wire bundle of, for example, 1% to 3%, relative to a diameter in the case of the most compact possible arrangement of the single wires without deformation of the single wires themselves. As a result of the compression, in particular the specific advantage of better rounding is also achieved, so that the surface of the wire bundle is further approximated to that of a cylinder jacket area. As a result, the coating material required for the extrusion and for the sheath is kept low. Furthermore, due to the compression, the wire bundle is at least already somewhat held together, so that the single wires do not diverge on the way to the extruder.

As previously explained, it is also provided that the shaping element rotates about the center longitudinal axis. In particular during the compression process, the outer single wires are highly strained in the longitudinal direction. This may potentially result in a break in the single wires. By rotating the shaping element, the longitudinal forces occurring are now laterally deflected, whereby the strain on the single wire is reduced. In order to achieve this, the rotational speed is preferably several 100 rpm and is in particular greater than 500 rpm. The shaping element is generally actively driven.

The risk of such a wire break exists in particular due to the generally very small cross sections of the single wires. The single wires, which are generally made of copper or a copper alloy, typically have a diameter of <1 mm, in particular even <0.5 mm.

For the application case of interest here, i.e., in particular for an application in the automotive field, in particular comparatively small lines, for example, according to the standards initially specified, are produced, in which the maximum diameter of the overall wire bundle within the conductor is in the range of 2 mm to 4 mm. Correspondingly, therefore, only a limited number of single wires, generally less than 60, preferably less than 20 single wires, is provided. In this case, the single wires typically have a diameter in the range from 0.11 to 0.40 mm or even up to 0.60 mm.

Overall, a conductor produced in this way has a breakage resistance comparable to that of a conventional stranded wire, in which the single wires are twisted together. However, the production effort is less than with a conventional stranded wire; therefore, the production costs are also lower. Such a cable thus constitutes a type of intermediate approach between a solid wire and a conventional stranded wire, which is advantageous for various application areas. Accordingly, via the method provided here, lines are preferably produced having at least one such conductor having a wire bundle made up of a number of single wires which are untwisted. Such a conductor is in particular used for single-conductor lines, but also for multiple-conductor lines. In the case of multiple-conductor lines, the single conductors are preferably combined by a common cable jacket. Alternatively, the single conductors are, for example, interconnected in the manner of a ribbon cable. Such in particular single-conductor or multiple-conductor lines are used in particular in the motor vehicle field. The method described here having the direct arrangement of the shaping element immediately ahead of the extrusion process is used in particular in unstranded, i.e., untwisted, wire bundles. Generally, this method may also be used in stranded, i.e., in concentrically stranded, and in particular also in bunch stranded, wire bundles. In particular in embodiment variants in which the wire bundle is compacted with the aid of the compacting unit, i.e., in particular the shaping sleeve.

Other features which are considered as characteristic for the invention are set forth in the appended claims.

Although the invention is illustrated and described herein as embodied in a method for producing an electrical line, an electrical line, and a vehicle on-board power supply system having a corresponding electrical line, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
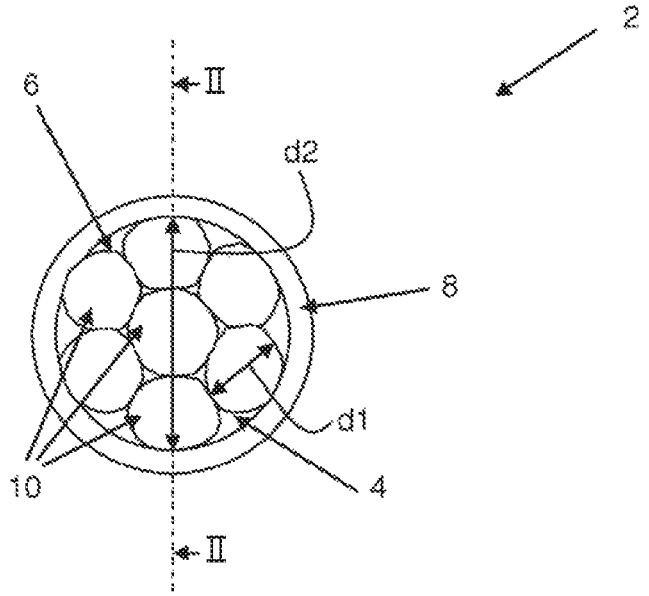
FIG. 1 is a diagrammatic, cross-sectional depiction of a single-conductor line.

Corresponding parts are provided with the same reference numerals in each case in all figures.

Referring now to the figures of the drawings in detail and first, particularly to FIG. 1 thereof, there is shown a single-conductor line 2 which is not depicted true to scale, is formed by a conductor 4.

The conductor 4 contains a wire bundle 6 which is enclosed by an insulating sheath 8 made of plastic. Each wire bundle 6 in the exemplary embodiment is made up of seven single wires 10 having a diameter d1<1 mm, wherein six single wires 10 rest circumferentially against a central single wire 10.

As depicted in FIG. 1, the wire bundle 6 is configured as a compressed wire bundle 6, and the single wires 10 are accordingly pressed together. As a result, the thickness of any wire bundle 6 or the diameter of any wire bundle 6 is reduced, and the cross sectional shape of any single wire 10 deviates from a round shape due to the deformation which any single wire 10 experiences in the course of compression of the wire bundle 6. The overall diameter d2 of the wire bundle 6 is, for example, in the range from 2 to 3 mm.

Figure 2:
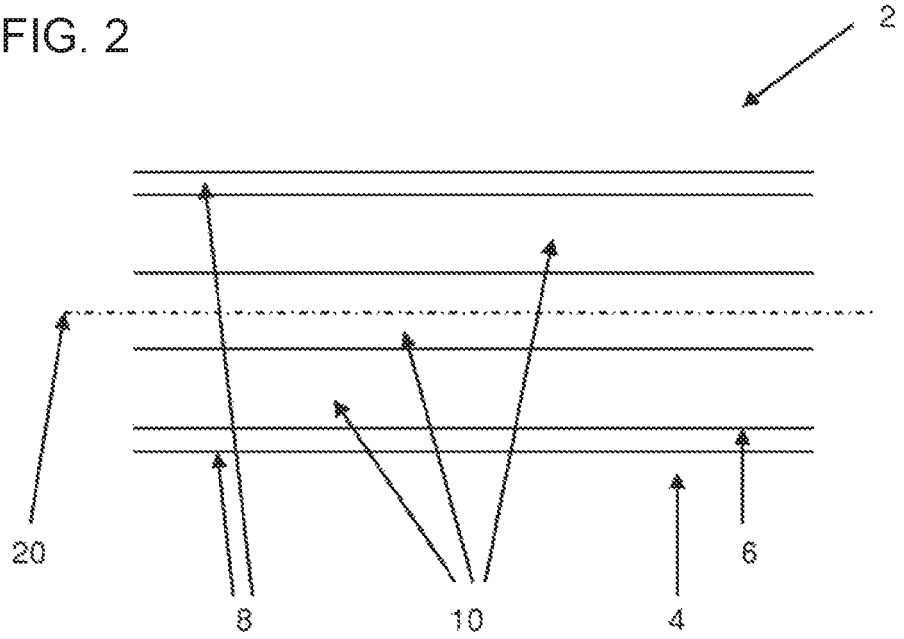
FIG. 2 is a longitudinal-sectional depiction taken along the line II-II shown in FIG. 1.

Due to this compression, the two wire bundles 6 each partially retain their shape even without the insulating sheath 8. Due to the compression, the cohesion between the single wires 10 is typically not so strongly pronounced as in the case of a conventional stranded wire, in which the shape of the stranded wire is permanent, in particular due to the directed twisting of the single wires 10. Such directed twisting is not provided in the wire bundles 6, as is schematically depicted in FIG. 2. The single wires 10 therefore run at least essentially in parallel with each other and with a center longitudinal axis. Thus, they are untwisted.

Figure 3:
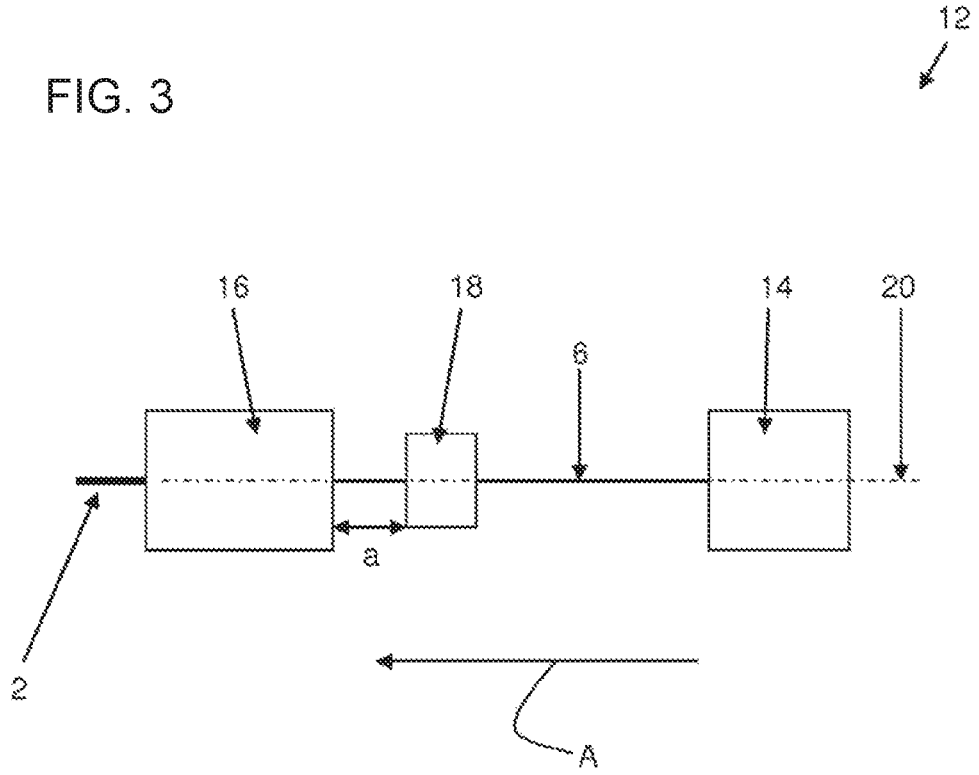
FIG. 3 is a top view of a production facility for the line.

In this case, the production of a corresponding cable 2 takes place in a production facility 12 as depicted in a manner not true to scale in FIG. 3. Here, the prefabricated single wires 10 are unwound from a wire reel 14, for example, in the form of a loose wire bundle 6, and continuously fed to an extruder 16, in which they are provided with the insulating sheath 8. Immediately ahead of the extruder 16, i.e., in a feed area seen in the processing direction A ahead of the extruder entrance, the single wires 10 are guided through a compressing unit, i.e., a shaping sleeve 18, with the aid of which the single wires 10 are bundled and deformed into a compressed wire bundle 6. An output of the shaping sleeve 18 is spaced away from an input of the extruder by a distance a. The distance a is preferably a maximum of a few meters, in particular less than 2 m, preferably approximately 0.5 m.

The processing speed, i.e., the speed at which the wire bundle 6 is drawn through the shaping sleeve 18, is typically 1000 to 2000 m/min.

In order to laterally deflect the forces occurring during compression and thus to reduce the risk of a wire break, the shaping sleeve 18 rotates at the same time about the center longitudinal axis 20 of the wire bundle 6. Preferably, it rotates at a speed of greater than 500 rpm, in particular approximately 1000 rpm.

In the extruder 16, the sheath 8 is subsequently extruded onto the wire bundle.

Instead of the shaping sleeve 18 described here, other compression units may also generally be used, as are used, for example, for rotary swaging of bundles. Here, multiple movable shaping jaws are arranged distributed around the circumference of the wire bundle 6, which compress the wire bundle 6 via coordinated movement sequences. However, this rotary swaging is generally used for significantly larger cross sections.

Furthermore, it is to be noted that the single wires 10 of the bundle 6 are hard-drawn and should not be soft annealed. In fact, analyses have shown that only hard-drawn wires may be compressed to the desired degree. Annealed wire material actually flows preferably only in the axial direction, without the desired compression, i.e., deformation in the radial direction of the single wires 10, taking place.

Figure 4:
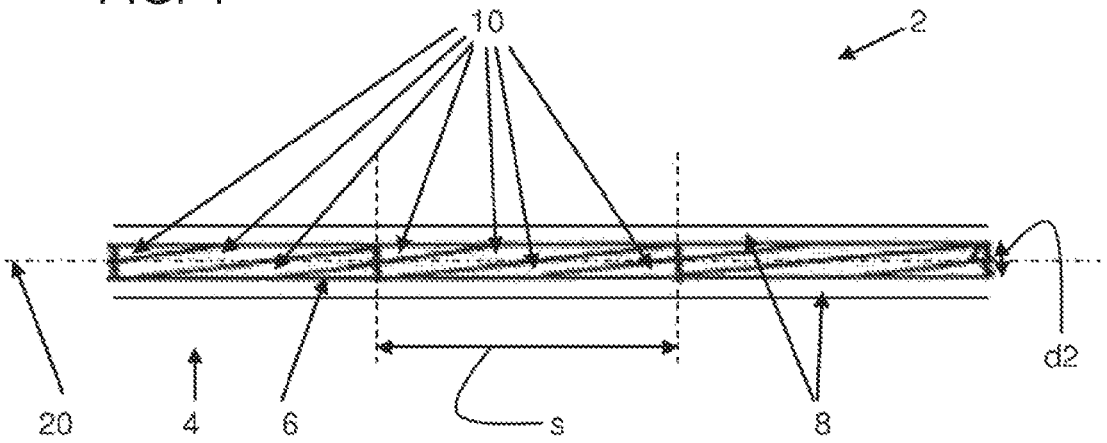
FIG. 4 is a longitudinal-sectional depiction of an alternative embodiment of the single-conductor line.

During the production of the cable 2, if the bundle 6 is not unwound from a wire reel 14 which is also rotating, but rather from a stationary wire reel 14, this typically results in bunching of the single wires 10 in the wire bundle 6 which is related to the unwinding process, which is not produced in a directed manner, having a lay length s of, for example, 2 m, as depicted in FIG. 4. Here, the lay length s denotes the length in which the wire bundle rotates once by 360° about its own center longitudinal axis. In this case, the lay length s of the unwinding process-related twisting or bunching is essentially a function of the diameter of the wire reel 14, and is essentially greater than a lay length according to the related art which is produced in a directed manner.

The present invention is not limited to the exemplary embodiment described above. Rather, other variants of the present invention may be derived from them by those skilled in the art, without departing from the subject matter of the present invention. In particular, furthermore, all individual features described in connection with the exemplary embodiment may also be combined with each other in a different manner without departing from the subject matter of the present invention.

The following is a summary list of reference numerals and the corresponding structure used in the above description of the invention:

2 Wire/cable
4 Conductor
6 Wire bundle/bundle
8 Sheath
10 Single wire
12 Production facility
14 Wire reel
16 Extruder
18 Shaping sleeve
20 Center longitudinal axis
A Processing direction
a Distance
d1 Diameter of single wire
d2 Diameter of wire bundle
s Lay length

The invention claimed is:

1. A method for producing an electrical line having at least one conductor with a wire bundle made up of a plurality of single wires, and an insulating sheath surrounding the wire bundle, which comprises the step of:

guiding the wire bundle through a shaping element along a center longitudinal axis in a feeding area immediately upstream of an extruder for specifying a cross-sectional shape of the wire bundle, wherein the shaping element rotates about the center longitudinal axis and relative to and around the wire bundle, and that thereafter, the insulating sheath is applied to the wire bundle by means of the extruder;

wherein as the wire bundle is guided through the shaping element in the guiding step, the shaping element brings the wire bundle into a desired circular cross sectional shape; and wherein the shaping element is a shaping sleeve.

2. The method according to claim 1, wherein the wire bundle has a lay length greater than 0.5 m.

3. The method according to claim 1, which further comprises positioning the shaping element at a distance of less than 2 m from the extruder.

4. The method according to claim 1, which further comprises positioning the shaping element at a distance of less than 0.5 m from the extruder.

5. The method according to claim 1, which further comprises compressing the wire bundle with the shaping sleeve.

6. The method according to claim 1, wherein a diameter of the wire bundle is reduced by at least 3%.

7. The method according to claim 1, which further comprises rotating the shaping element at a speed of at least 500 rpm.

8. The method according to claim 1, wherein the single wires in the wire bundle are untwisted or the wire bundle is formed with a lay length down greater than 2 m.

9. The method according to claim 1, wherein the single wires in the wire bundle are untwisted.

* * * * *